United States Patent [19]

Shapiro

[11] 4,367,981

[45] Jan. 11, 1983

[54] FLUID PRESSURE-TENSIONED SLIP JOINT FOR DRILLING RISER

[75] Inventor: Maurice S. Shapiro, Oxnard, Calif.

[73] Assignee: Combustion Engineering, Inc., Windsor, Conn.

[21] Appl. No.: 278,810

[22] Filed: Jun. 29, 1981

[51] Int. Cl.[3] ..... E02D 21/00; E21B 7/128

[52] U.S. Cl. ..... 405/195; 175/7; 175/321; 166/355

[58] Field of Search ..... 405/195, 224; 166/355, 166/359; 175/7, 321; 141/388; 285/302

[56] References Cited

U.S. PATENT DOCUMENTS

| | | | |
|---|---|---|---|
| 3,217,805 | 11/1965 | Howarel | 166/355 X |
| 3,353,851 | 11/1967 | Vincent | 166/355 X |
| 3,427,051 | 2/1969 | White et al. | 285/302 X |
| 3,643,751 | 2/1972 | Crickmer | 175/7 |
| 3,764,168 | 10/1973 | Kisling et al. | 285/302 |
| 4,211,290 | 7/1980 | Mason et al. | 175/321 |

*Primary Examiner*—David H. Corbin
*Assistant Examiner*—Nancy J. Pistel
*Attorney, Agent, or Firm*—Arthur L. Wade

[57] ABSTRACT

A drilling riser between a subsea wellhead and a floating platform has a slip joint in its upper end. A chamber is formed within the slip joint and supplied fluid pressure to develop a tensioning force on the upper end of the riser as the floating platform cycles vertically under the influence of heave and tidal forces.

3 Claims, 4 Drawing Figures

FLUID PRESSURE-TENSIONED SLIP JOINT FOR DRILLING RISER

TECHNICAL FIELD

The present invention relates to structure for compensating for relative motion between the drilling riser and a floating platform. More particularly, the invention relates to the maintenance of tension on a drilling riser by the unbalance of fluid pressure forces within a slip joint at the upper end of the drilling riser.

BACKGROUND ART

Floating drill rigs utilize a drilling riser which connects the platform to the wellhead on the sea floor. The drilling riser serves as a guide and conduit for the drill string and various tools, as well as the channel to return drilling fluids to the surface. Drilling risers normally incorporate a telescopic slip joint at the uppermost section to allow for variations in the distance from the sea floor to the platform as the platform heaves, due to action of the sea. In addition, the drilling riser must be held in constant tension to prevent its structural damage by reason of its fixed attachment to the wellhead.

It is present practice to maintain tension in the drilling riser by mechanical connection between the top of the riser and a number of hydraulic or hydro-pneumatic cylinders maintained under approximately constant pressure by means of an air or air/hydraulic accumulator. The cylinders maintain tension on wire ropes or chains which are reaved around a number of sheaves at the blind and rod ends of each cylinder. The free end of the wire rope or chain is then passed to the outer (or fixed) barrel of the riser slip joint where it is secured to an attaching member. By virtue of the compensating motion of the tensioner cylinders, the effective length of the rope or chain thus varies with the motion of the platform while maintaining tension on the fixed section of the drilling riser anchored at its lower end to the wellhead. The inner (or free) barrel of the riser slip joint is fixed to the platform to move vertically with the heave of the platform, barge, or vessel, resulting in a varying length of riser.

While the rope and pulley form of tensioners has proven essential for the proper operation of a drilling riser, they have serious drawbacks. This form of tensioner has normally been installed in multiple pairs. Pairing of the tensioners is necessary to provide a balanced force so that the drilling riser is not diverted transversely during its drilling operation. If one tensioner malfunctions, the opposing tensioner must be taken out of service so that it does not cause an unbalanced side force; thus, at least one redundant pair of tensioners must always be installed in the event one pair of tensioners fails. Normal operations have incorporated a minimum of four tensioners to as many as twelve or more tensioners.

Deck space has always been at a premium on a drilling platform. The installation of multiple tensioners requires consideration of deck loading and available space for installation. Often, the only available space is relatively remote, and wire ropes of the tensioners must be run below deck and routed over turning sheaves to a location where it can finally be passed to the drilling riser slip joint. In addition, the constant motion of the wire rope causes a progressive weakening of the rope, requiring a planned program of replacement for each of the numerous ropes involved in the system. During continuous drilling operations in heavy seas, the ropes may require replacement as frequently as weekly. This operation is difficult, time-consuming and dangerous.

It is apparent, from the description above, that the present hydraulic mechanism, and its connection to the drilling riser, is an unconscionable complication. Revolutionary thought is needed to eliminate this network of ropes connecting the riser to the fluid power structure mounted on the platform to keep tension applied upon the riser. An arrangement of structure is needed to incorporate the fluid power structure into the slip joint at the top of the drilling riser.

Although the prior art discloses slip joints in drilling risers, the slip joints are neither realistically positioned in the riser, nor supplied fluid pressure for exerting tension in the proper direction on the length of the riser. Apparently, workers in the prior art naively assumed that a slip joint could be placed on the lower end of the riser and fluid pressure could be applied to the chambers in the slip joint by the drilling mud filling the riser. The plan, on paper, was to hang the major length of the drilling riser from a rigid connection to the floating platform and provide for the heave-compensating stroke in the slip joint at the sub-surface wellhead. Representative disclosures of this prior art are listed below:

| U.S. Pat. No. | Issued |
|---|---|
| 3,643,751 | February 22, 1972 |
| 3,647,245 | March 7, 1972 |
| 3,955,621 | May 11, 1976 |

These three disclosures illustrate the slip joint on the lower end of the drilling riser. A source of pressure alternate to the drilling mud is also shown as compressed air from an accumulator. Regardless of whether the fluid pressure applied on the slip joint chambers is from drilling mud, or an external source of fluid pressure, the weight of the drilling riser, itself, suspended from the floating platform, is visualized as the means of maintaining the riser in tension.

These disclosures are completely unrealistic. They may have appeared attractive on paper, but the harsh realities resulting from suspending the major length of the drilling riser from the heaving platform must have been the deterrent to reducing these disclosures to practice. There is no riser presently employing this system.

The drilling riser is filled with drilling mud, along with the drill string, in actual operation. If the riser is anchored to the wellhead and the drill string is properly operated with a heave compensator, there is little or no ram effect from the drill string collars impacting on the drilling mud. However, if the drill string is fixed by its upper end to the heaving platform, the result would be a relative movement of the drilling riser, drilling mud, and the drill string, with its collars, creating a ram effect and resulting in a force transmitted to the floating platform of devastating magnitude. The ram effect, plus the inertial forces generated by the heaving length of the drilling riser connected to the platform, along with its drilling mud, would simply be an intolerable force transmitted to the platform.

When the reality is faced that the drilling riser is at least 20" in diameter, is filled with drilling mud, and is heaved up and down with the drilling platform, the inertial forces created by this mass on the drilling platform would create stresses of almost incalculable magnitude. Any plan which includes rigid attachment between the major length of the riser, by its upper end, to the heaving drilling platform is obviously specious. Not only is the basic force unacceptable, but the difficulty of servicing and replacing the moving parts of the slip joint at the wellhead are a nightmare to contemplate. Even the use of drilling mud, as a source of fluid pressure for the slip joint chambers, ignores the practical facts that this material is too abrasive for this service. The validity of any part of this prior art arrangement crumbles at the first touch of reason.

DISCLOSURE OF THE INVENTION

The present invention contemplates a piston-cylinder configuration mounted at the upper portion of the drilling riser and a barrel member telescoped down over the upper end of the riser. A seal structure is provided between the drilling riser and barrel which enables fluid pressure to be applied within the sealed chamber to maintain the force of tension upward on the end of the riser while the platform to which the barrel is attached rises and falls with both heave and tidal action.

The invention further contemplates a seal mounted on the upper end of the drilling riser and bearing upon the inner surface of the barrel suspended from the platform while a second seal is mounted on the internal surface of the barrel and bears upon the outer surface of the riser. Fluid pressure is maintained between the two seals as the platform, to which the barrel is attached, moves vertically, maintaining the required tensioning force upward on the end of the drilling riser.

The invention further contemplates the barrel suspended from the platform and the upper portion of the drilling riser sized to accommodate the suspended barrel telescoped within the upper portion of the riser. A seal structure is provided between the drilling riser and barrel which enables fluid pressure to be applied within the sealed chamber to maintain the force of tension upward on the end of the riser while the platform, to which the barrel is attached, moves vertically.

The invention further contemplates a seal mounted on the upper end of the drilling riser and bearing upon the outer surface of the suspended barrel, while a second seal is mounted on the lower end of the suspended barrel and bears upon the inner surface of the riser. Fluid pressure is maintained between the two seals as the platform, to which the barrel is attached, moves vertically, maintaining the required tension upward on the end of the riser.

The invention further contemplates two portions of a drilling riser formed as two concentric cylinders, the outer of which is termed a barrel, and the inner of which is termed a sleeve. The other riser portion is received between the barrel and sleeve to form a pressured chamber with the barrel, while sealed to the sleeve to isolate the pressured chamber seals from the drilling mud within the riser.

Other objects, advantages and features of this invention will become apparent to one skilled in the art upon consideration of the written specification, appended claims, and attached drawings.

BRIEF DESIGNATION OF THE DRAWINGS

BEST MODE FOR CARRYING OUT THE INVENTION

GENERAL TERMINOLOGY

Figure 1:
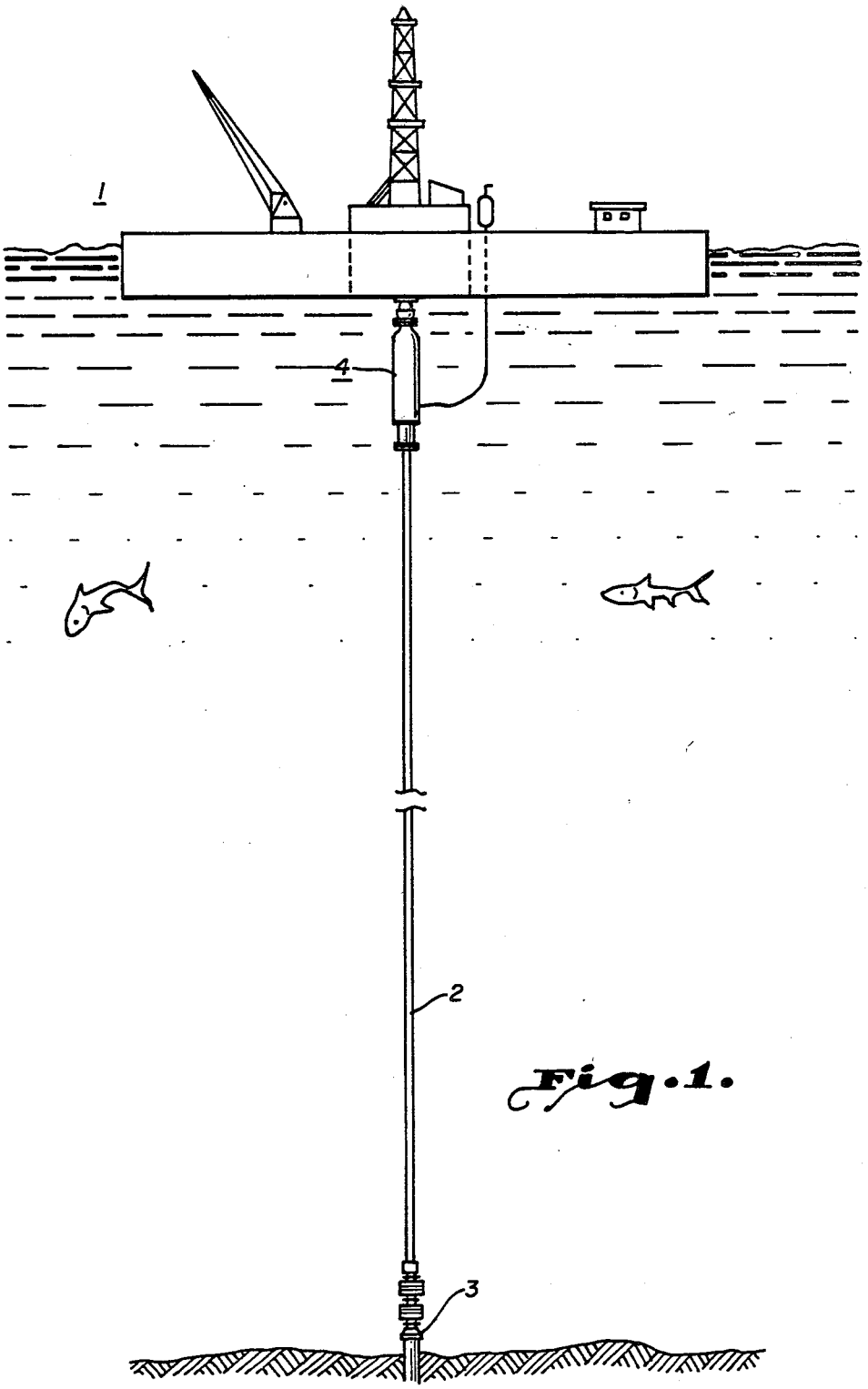
FIG. 1 is a perspective elevation disclosing a drilling riser between a sub-sea wellbore and a floating drilling platform with a slip joint embodying the present invention.

The drawing disclosure will not be occupied with elaborate depictions of the subsurface wellhead and floating platform. The prior art, cited above, carries out this function quite adequately. For any purpose of complete disclosure of the environment of the invention, the cited background art is specifically incorporated by reference.

The drilling riser is a necessary tubular extension of the wellbore. Whether it is termed a riser, tube, pipe, or conduit, this structure guides the drill string from its floating platform down into the wellbore. Also, the drilling mud carried down into the wellbore, through the drill string, returns up the annulus between the string and drilling riser. All of the terminology related to this structure is well established in the prior art and any slight deviation therefrom will be readily understood by those skilled in the art.

The drilling riser, of course, is in sections, just as the drill string is formed in sections, or stands. When assembled, the sections of the riser are referred to as a unit.

The basic problem has been well discussed. Where the drilling platform cannot be firmly mounted in fixed elevation to the wellhead, it is tethered at the surface of the body of water and over the wellhead. Heaving takes place, as well as tidal changes. The tethering of the floating platform attempts to minimize transverse movement of the platform. With all of the raging elements of the cruel sea, the engineer has his ingenuity strained to many of its capacities in stabilizing the positional relationship between the floating platform and the wellhead.

One of the major decisions in communicating the subsurface wellhead and its floating platform, centers about the drilling riser. Obviously, the heave of, and the tidal changes on, the platform dictates a slip joint somewhere in the length of the riser. The prior art cited suggests the slip joint at the wellhead. The actual practice at the present, is to mount the slip joint at the top of the drilling riser and maintain tension in the riser through a mechanical connection of wire ropes sheaved between the upper end of the riser and hydraulic piston/cylinder units mounted on the drilling platform. The vulnerability of the wire rope connection between the drilling riser and hydraulic piston/cylinder units has been described. The present invention proposes to incorporate the structure generating fluid pressure force into the slip joint at the upper end of the drilling riser.

Beneath the broad concept of incorporating a fluid pressure chamber in the upper slip joint of the drilling riser, are the seals defining the fluid-pressure chamber in the slip joint, the connection between the chamber and the source of fluid pressure, structure which positively isolates the drilling mud from the chamber, and the connection between the fluid pressure source and the chamber.

The drilling riser will be described as in two portions. The longer portion, extending from the sea floor, will terminate close to the drilling platform tethered above. The second portion of the riser will be attached firmly to the drilling platform to depend downward and telescope with the upper end of the first portion of the riser. This telescoping relationship of the two portions of the drilling riser form the slip joint.

Once the description focuses upon the slip joint, the sizes of the telescoping sections will be enlarged so that one portion is accommodated within the other to form a chamber of the annulus between the walls of the portions. These telescoping sections of the drilling riser portions will be termed "barrels", notwithstanding the fact that they are, essentially, no more than extensions of their riser portions.

A chamber will be formed in the annulus of the telescoped barrels by a pair of seals, one of which is mounted on the lower riser portion barrel, and the second of which is mounted on the upper riser portion barrel. The force generated and maintained in the annulus chamber will determine the upward tensioning force on the lower riser portion. The size of this chamber, and the fluid pressure available for it, will determine the amount of force generated for tension. It is desirable to maintain this tension force constant during elevation changes of the platform. This objective is a huge challenge as the heave of the drilling platform and the attached upper riser portion alternately decreases and increases the volume of the chamber.

The basic approach to maintaining the slip joint chamber pressure, and resulting upward tensioning force, substantially constant, is to connect this chamber to an accumulator of such large volume that the change in chamber volume will vary the total volumes of the chamber and accumulator relatively little. More specifically, the accumulator vessel can be mounted on the drilling platform and be sized so much larger than the slip joint chamber that the vertical movement will vary the total volume of the chamber and accumulator but a small amount.

The accumulator and slip joint chamber may be connected together and filled with gas. Alternatively, hydraulic fluid may fill the chamber and the lower part of the accumulator vessel. A vapor space in the accumulator vessel will function as a fluid pressure spring as the hydraulic fluid flows back and forth between the chamber and accumulator. With either arrangement, the pressure of the fluid in the chamber will act upon the seal mounted on the upper end of the first riser portion barrel to give the required upward tensioning force. In either arrangement, the fluid pressure of the accumulator can be provided from a compressor mounted on the drilling platform and controlled to adjust the fluid pressure of the accumulator to make up leakage and change the tensioning force as required by all forces applied to the length of the riser, whether from transverse currents going over the length of the riser pipe, or the heave magnitude and frequency.

THE DRILLING PLATFORM AND WELLHEAD

FIG. 1 discloses the familiar orientation between a floating drilling platform 1, drilling riser 2 and wellhead 3. More than sufficient description of the relationship between these three elements has been included in the prior art, such as U.S. Pat. No. 3,643,751, and is simply incorporated here by reference. The function of the drilling platform, in its support of rotary drilling equipment, need not be repeated. A drill string extends down through the drilling riser 2 to enter the wellhead 3 on the ocean floor. The drilling fluid pumped down the drill string is returned to the platform through riser 2. The problem which is now becoming ancient, is the maintenance of tension in the drilling riser 2.

Riser 2 is in a cylindrical form, made up of many sections threaded together which must be firmly attached by its lower end to wellhead 3, and to platform 1 by its upper end. This column cannot withstand compressive force which will result from the heave of platform 1 and tides to which it is subjected. FIG. 1 serves the purpose of emphasizing that the present invention includes the concept of a slip joint 4 in the drilling riser 2. Further, the concept includes providing a chamber in slip joint 4 which can be pressured with fluid to apply an upwardly tensioning force on the major length of riser 2, the lower end of which is firmly attached to wellhead 3.

As has been expounded, it has been the common practice to attach flexible cables between a hydraulic cylinder-piston system on platform 1 and the upper end of the lower portion of drilling riser 2. The present invention proposes the elimination of this mechanical connection and the substitution of a fluid pressure chamber within the slip joint 4 to provide the tension required for the lower part of riser 2.

BASIC SLIP JOINT

Figure 2:
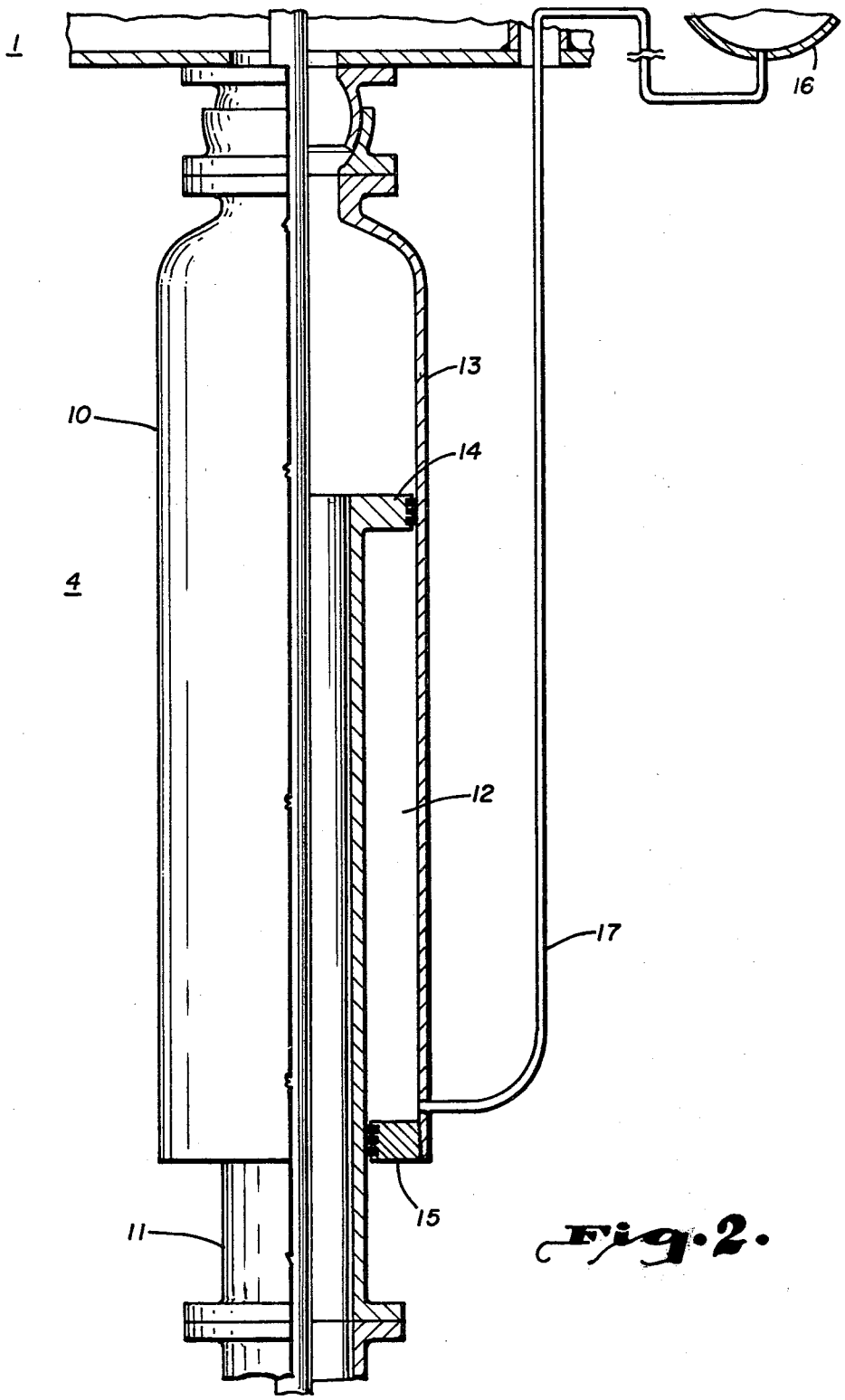
FIG. 2 is a sectioned elevation of the slip joint of FIG. 1 in which the upper portion of the drilling riser is telescoped over the end of the lower portion of the riser.

FIG. 2 focuses attention on the slip joint 4 of FIG. 1 as such joint is formed between the two portions of drilling riser 2. The descriptive technique is to designate the short, upper portion of the riser 2 as 10, and the longer, lower portion of riser 2 as 11. The slip joint is formed by these two portions of riser 2 telescoping within each other to form a pressured chamber 12.

In FIG. 2, the preferred telescoping relationship of drilling riser portion 11 is telescoped up into depending riser portion 10. As the upper portion 10 of riser 2 is enlarged to accommodate the telescoping riser portion 11, this larger diameter is provided by a separate section attached as an extension to the lower end of riser portion 10. This enlarged section of enlarged diameter is termed barrel 13. Drilling riser portion 10 and barrel 13 are a unit, one being an extension of the other. Of course, riser portion 10 could be given the diameter throughout its length to telescope down over riser portion 11. For the purposes of description, it makes no difference whether there is a separate, enlarged section to be termed barrel 13, or the entire upper riser portion to be designated 10. They are both the same unit sized with the diameter 10 to accommodate the upper end of riser portion 11 in forming slip joint 4.

A first seal body 14 is mounted on the upper end of drilling riser portion 11 to extend radially outward. This transverse extension is sized to engage the wall of barrel 13 in a sliding/sealing relationship. A second seal body 15 is mounted on the lower end of barrel 13 to also extend transversely into sealing/sliding engagement with the wall of drilling riser portion 11. Thus, pressured chamber 12 is completed in the annulus between the riser portions and the two seal bodies. Fluid pressure in this chamber will develop a force upward on the first seal body 14 of sufficient magnitude to place the entire length of a riser portion 11 in tension.

The fluid pressure developed in chamber 12 is established in accumulator chamber 16. Accumulator chamber 16 is preferably mounted in fixed relationship to platform 1 so that conduit 17, communicating the chambers 12 and 16, may be comparatively rigid.

ALTERNATE TELESCOPING

Figure 3:
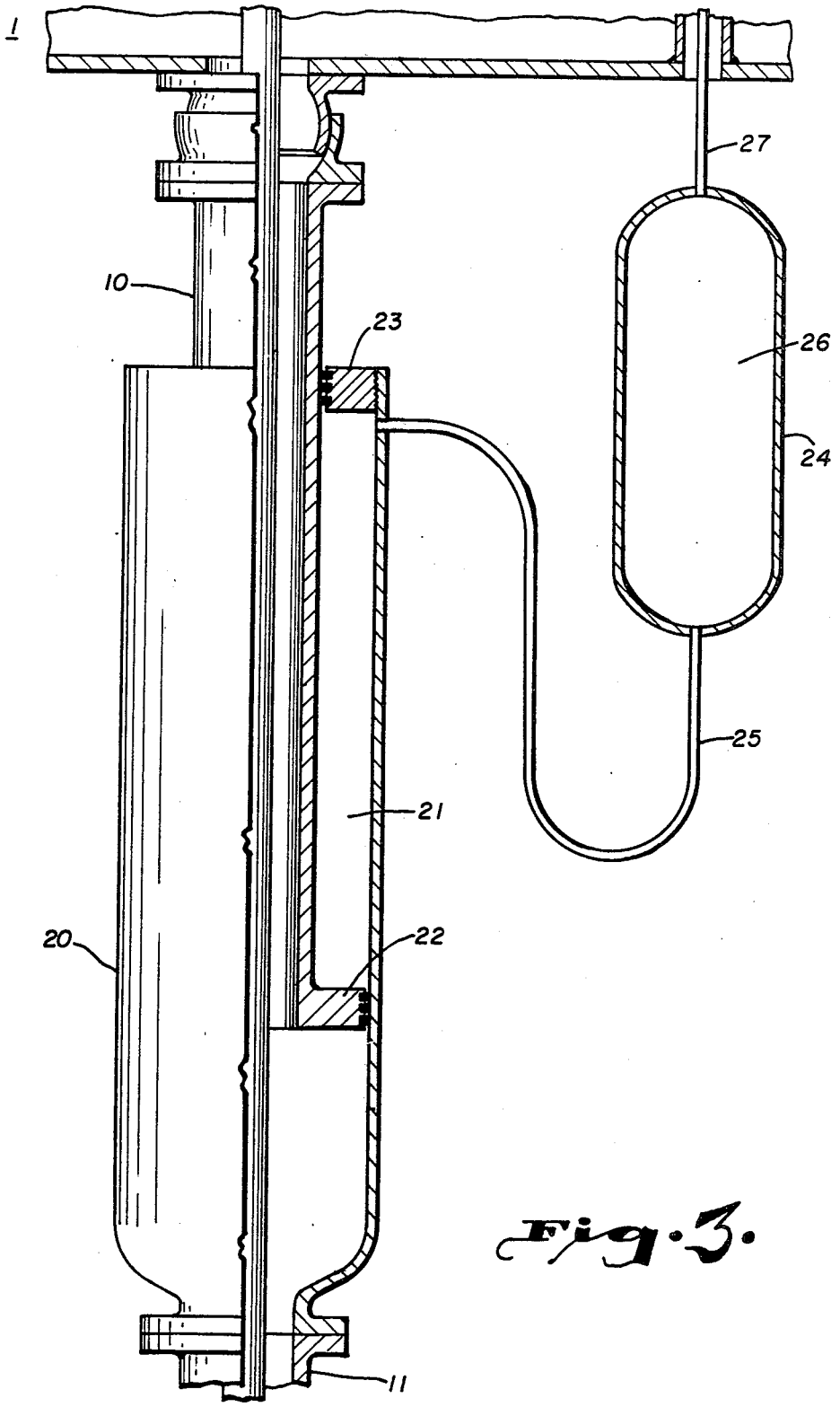
FIG. 3 is a sectioned elevation of a slip joint wherein the upper portion of the drilling riser is telescoped within the lower portion of the riser.

FIG. 2 presently appears to be the preferred mode of telescoping the ends of the two portions of the drilling riser. With the upper riser portion having a stable relationship to the floating platform and the pressured chamber of the joint connected to the platform-mounted accumulator, these three structures move together with the up and down motion generated by waves and tides. Alternatively, as has been previously indicated, it may be desirable to telescope the upper riser portion down into the lower riser portion in forming the slip joint with its pressured chamber. FIG. 3 discloses this arrangement.

Again, platform 1 is indicated. The wellhead 3 of FIG. 1 is not shown in FIG. 3. Essentially, the scope of FIG. 3 equals that of FIG. 2 in disclosing a slip joint 4. However, the slip joint of FIG. 3 may be described as structurally reciprocal to the slip joint of FIG. 2. The upper riser portion is sized and arranged to slide down inside the barrel extension of the lower riser portion.

To maintain the proper structural relationship between the slip joint of FIG. 2 and the slip joint of FIG. 3, depending upper riser portion 10 is designated along with lower riser portion 11. However, in FIG. 3, barrel 20 is now provided as an enlarged upper section attached to the upper end of riser portion 11 and is sized with the diameter to receive upper depending riser portion 10 to form pressured chamber 21 in their annulus.

Comparable to the seal arrangement of FIG. 2, seal 22 is mounted on the lower end of riser portion 10 to extend radially outward into sliding/sealing engagement with the inner wall of barrel 20. Seal 23 is mounted on the upper end of barrel 20 to extend radially inward to engage in sliding/sealing contact with the outer wall of riser portion 10. Pressured chamber 21 is, therefore, formed between seals 22 and 23 and in the annulus between the walls of the telescoped riser portions.

Chamber 21 is supplied a fluid pressure from accumulator 24. Chamber 24 is disclosed in close physical association with barrel 20 to emphasize that they may be mounted in fixed relationship to each other so that connecting conduit 25 will not need to be flexible. If chamber 24 were mounted in fixed relationship to platform 1, relative movement between platform 1 and riser portion 11 would necessitate some form of flexible conduit between chamber 24 and chamber 21 to accommodate the relative motion between the two.

As with FIG. 2, the fluid pressure generated in chamber 21 directs an upward force on seal 23 as the tensioning force ultimately required on riser portion 11. Also, this FIG. 3 serves as a convenient location in the disclosure to emphasize that the fluid moved between chamber 21 and chamber 24 can be liquid. The vapor space 26 in chamber 24, above the liquid surface, can be maintained by a compressor connected to the vapor space by conduit 27. The pressure required for the fluid, and the volumes required for the chamber 24 and chamber 21 to provide the required upward tensioning force on seal 23, fall into the realm of design. Finally, it is obvious that if barrel 20 and chamber 24 are fixed in relationship to each other, conduit connection 25 may be relatively inflexible, but conduit 27 connected to a compressor on platform 1 would have to be flexible.

ISOLATING THE DRILLING MUD

Thus far, the disclosure has been of structure energized by fluid pressure to generate a substantially constant force of tension on the upper end of a drilling riser. The pressured chamber, formed within the annulus between telescoped portions of the riser, has at least one of its seals directly exposed to the drilling mud flowing up the riser.

Now, drilling mud is composed of many ingredients, most of which are solid particles having highly abrasive characteristics. Additionally, the drilling mud flushes cuttings from the bottom of the bore hole up the drilling riser. Although this mud is fluidized by the addition of water, it is an anathema to sealing surfaces. The scouring action of the drilling mud will significantly shorten the effective life of moving parts, including seals, with which it comes into contact, as any mud pump manufacturer and operator will attest.

Figure 4:
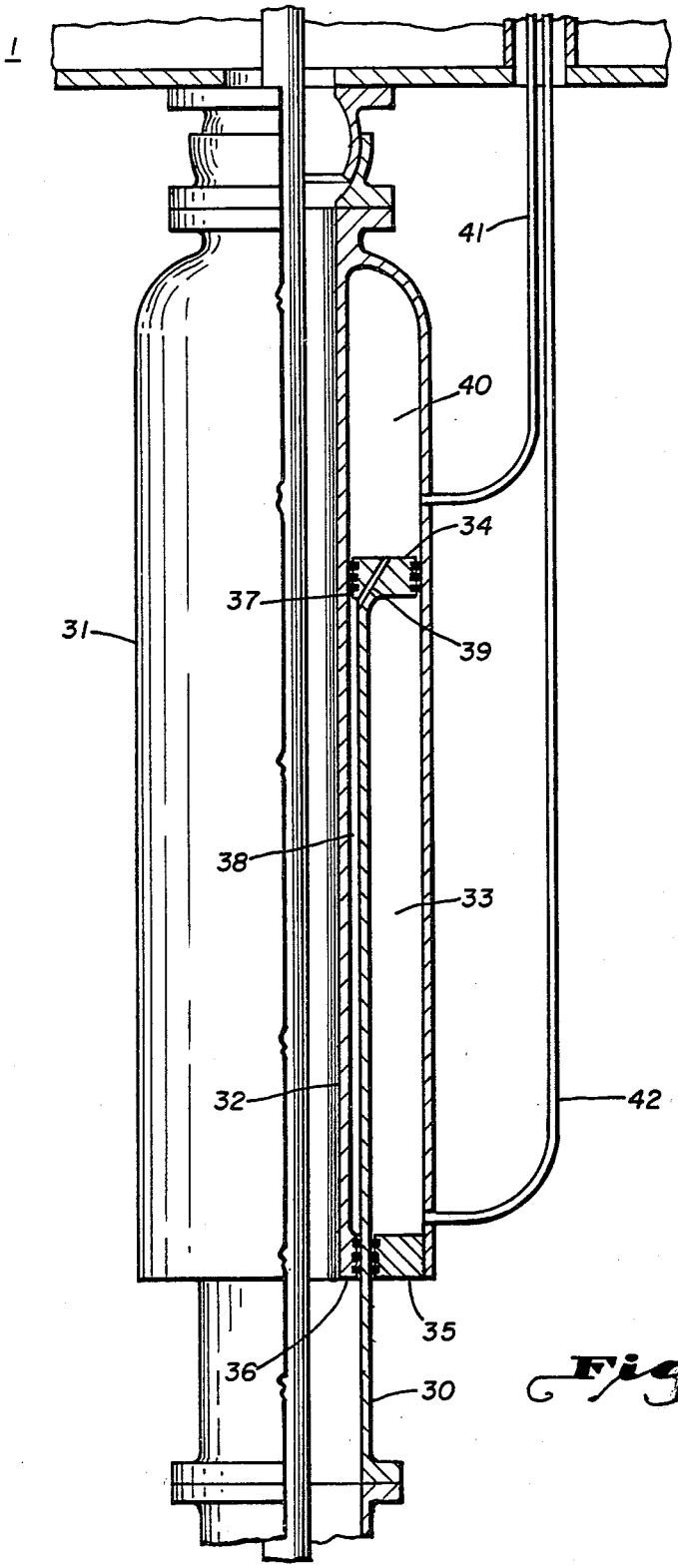
FIG. 4 is a sectioned elevation of the form of slip joint disclosed in FIG. 2 including an isolation sleeve between the drilling mud and the fluid pressure chambers of the joint.

FIGS. 2 and 3 have been deliberately simplified in showing the formation of pressured chambers 12 and 21 with seals 14 and 22 exposed directly to the drilling mud flowing upward through the drilling riser. Therefore, the internal surfaces of the barrels 13 and 20, above the seal 14 and below seal 22, are scoured by this drilling mud. The result of this abrasive fluid passing over these surfaces and working its way between the seals and these surfaces, is to court disaster. Excessive wear will take place and effective sealing will be lost. The prior art naively utilizes drilling mud as a pressure fluid in its slip joints, ignoring its detrimental abrasive potential. In contrast, an object of the present invention is to isolate this abrasive medium from the working surfaces of the present embodiment of the slip joint. FIG. 4 is established to disclose how this isolation may be implemented.

The isolating structure disclosed in FIG. 4 appears to be a relatively simple addition to the structure of FIG. 2. Similar structure is readily added to FIG. 3, as well, but FIG. 4 will follow the plan of FIG. 2, leaving to reasoning how the isolating structure may be added to FIG. 3. Simple as this isolating structure is, there are difficulties in describing it accurately.

To begin, FIG. 4 discloses platform 1 from which the tensioned drilling riser depends down to a well, not shown. Specifically, the upward tensioning force is applied to the upper end of riser portion 30. The upper portion of the riser, connected to the platform 1, is characterized by barrel 31. The structure added to the FIG. 2 arrangement, as shown in FIG. 4, is sleeve 32.

Both barrel 31 and sleeve 32 are cylinders connected at their upper ends to that portion of the riser connected directly to platform 1. Therefore, relative to the upper end of riser portion 30, barrel 31 and sleeve 32 presents a double-walled, downwardly-opened chamber into which the upper end of the riser portion 30 extends. This reception of the riser portion 30 in the annulus between the walls of the sleeve and barrel is a telescoping relationship, comparable to the telescoping relationship in the joints of FIGS. 2 and 3. The pressured chamber 33, formed between the outside surface of riser portion 30 and the inside surface of barrel 31, is similar to the pressured chamber 12 of FIG. 2.

The pressured chamber 33 is completed by seal body 34 mounted on the upper end of riser portion 30, and seal body 35 mounted on the lower end of barrel 31.

Seal body 34 extends radially from its mount on the upper end of riser portion 30 to engage the internal wall of barrel 31. Seal body 35, mounted on the lower end of barrel 31, extends radially into engagement with the external surface of riser portion 30. Fluid pressure within chamber 33 generates the upward force on seal body 34 which holds drilling riser portion 30 in the required tension. Thus far, the pressured chamber formation with the upper end of the lower riser portion, and the barrel of the upper riser portion, is precisely the same arrangement as disclosed in FIG. 2. The orientation of this structure with the isolation structure embodied in sleeve cylinder 32 can be readily understood.

Sleeve 32 extends down into close telescoping arrangement with the upper end of riser portion 30. When sealed to the inner surface of this riser portion 30, the drilling mud, flowing up the drilling riser, is isolated from the seal body 34 and thereby provides protection of this seal from the abrasive drilling mud. The seal is provided on the lower end of sleeve cylinder 32 and extends radially into engagement with the internal surface of riser portion 30. From one viewpoint, this seal 36 appears as a portion of seal 35, the two portions divided by the riser portion 30. Similarly, a seal body 37 is mounted on the upper end of riser portion 30 to extend radially into engagement with the external surface of sleeve cylinder 32. Again, seal body 37 and seal body 34 may be viewed as a single seal mounted on the upper end of riser portion 30 spanning the annulus between the internal surface of barrel 31 and sleeve cylinder 32.

A chamber 38, small in comparison to pressured chamber 33, is formed between seal bodies 36 and 37. A passageway 39 is formed between seal bodies 34 and 38 to connect small chamber 38 and chamber 40. Both of these chambers are connected to a source of pressure through conduit 41. Pressured chamber 33 is connected to its fluid pressure through conduit 42, which extends through the wall of barrel 31.

The operation of the structure of FIG. 4 needs little explanation. With the drilling mud flowing through the drilling riser, and platform 1 changing its vertical height, the function of the seals is apparent from an inspection of the drawing disclosure. Sufficient fluid pressure is provided chamber 33 to maintain a constant tension on the upper end of riser portion 30 throughout the range of changes in the volume of this chamber. Of course, the volumes of chambers 38 and 40 also change. The pressure maintained in these connected chambers is preferably maintained at a level which will militate against migration of the drilling mud past seal body 36. Therefore, the working seals of the pressured chamber are protected from the drilling mud, insuring their efficiency over a long life span.

CONCLUSION

With the form of the slip joint of FIG. 2, completed with the isolating cylinder of FIG. 4, there is disclosed what will probably be the preferred embodiment of the invention. The pressured chamber of the slip joint will be supplied fluid from an accumulator chamber mounted on the floating platform, the chamber pressure, in turn, being maintained by a compressor. The hose, or pipe, connection between this pressure system and the slip joint chamber, is relatively rigid as all three structures move vertically together.

The invention is conceived in the slip joint being first mounted on the upper end of the drilling riser. Second, the concept includes this pressured chamber in the slip joint to generate the upward force on the riser to maintain the necessary tension as the platform moves vertically. Third, the invention includes the conception of an effective barrier to contain the drilling mud and isolate the piston seal to which the tensioning force is applied. All the structures embodying these features are relatively accessible for repair, replacement and maintenance near the surface on which the drilling platform floats.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A slip joint for a drilling riser, including, a first portion of the drilling riser, a second portion of the drilling riser comprising a sleeve which is sized in diameter to telescope within the first riser portion, a first seal body mounted on the end of the sleeve of the second riser portion engaging the internal wall of the first riser portion to contain drilling fluid flowing within the telescoped riser portions, a barrel member connected to the external surface of the second riser portion and extending over the telescoped end of the first riser portion, a second seal body mounted on the end of the barrel and extending radially into sliding and sealing engagement with the external surface of the first riser portion, a third seal body mounted on the end of the first riser portion and extending radially into sliding/sealing engagement with the internal wall of the barrel member to form a first fluid pressure chamber with the second seal body in the annulus between the barrel member and the external surface of the first riser portion and a second chamber formed with the first seal body and the third seal body in the annulus between the barrel member and the external surface of the sleeve of the second riser portion, a first supply of fluid pressure connected to the first chamber through the wall of the barrel to generate the force on the second seal body directed to provide a tensioning force on the first riser portion, and a second supply of fluid pressure connected to the second chamber through the wall of the barrel to generate the pressure sufficient to exclude drilling fluid from passing between the seal surfaces of the first seal body and the internal wall of the first riser portion.

2. The slip joint of claim 1, in which, the first riser portion is connected to a subsurface well and extends up to the slip joint near the surface of the body of water over the well, and the second riser portion is fixedly connected to a floating drilling platform anchored to move vertically over the subsurface well.

3. A slip joint for a drilling riser, including, a first portion of the drilling riser, a second portion of the drilling riser sized in diameter to telescope within the first riser portion, a first seal body mounted on the lower end of the second riser portion engaging the internal wall of the first riser portion to contain drilling fluid flowing within the telescoped riser portions, a barrel member connected to the external surface of the second riser portion and extending over the telescoped end of the first riser portion, a second seal body mounted on the lower end of the barrel and extending radially into sliding and sealing engagement with the external surface of the first riser portion, a third seal body mounted on the upper end of the first riser portion and extending radially into sliding/sealing engagement with the internal wall of the barrel member to form a first chamber between the second and third seal bodies in the annulus between the barrel member and the external surface of the first riser portion, a fourth seal body mounted on the upper end of the first riser portion and extending radially into sliding/sealing engagement with the external surface of the second riser portion to form a second chamber with the first seal body and a third chamber above the third and fourth seal bodies in the annulus between the second riser portion and the barrel member, a passage between the third and fourth seal bodies to communicate the second and third chambers, a first conduit for fluid pressure connected through the wall of the barrel member into the first chamber to generate the force on the second seal body to provide a tensioning force on the first riser portion, and a second conduit for fluid pressure connected through the wall of the barrel member into the third chamber to provide a sufficient pressure in both the second and third chambers in militate against the migration of drilling fluid between the first seal body and the internal wall of the first riser portion.

* * * * *